US008607369B1

(12) United States Patent
Al-Khattaf

(10) Patent No.: US 8,607,369 B1
(45) Date of Patent: Dec. 17, 2013

(54) THERAPEUTIC FOOTREST FOR USE WHILE ON A TOILET

(71) Applicant: Solaiman B. S. A. Al-Khattaf, Al Qadsia (KW)

(72) Inventor: Solaiman B. S. A. Al-Khattaf, Al Qadsia (KW)

( * ) Notice: Subject to any disclaimer, the term of this patent is extended or adjusted under 35 U.S.C. 154(b) by 0 days.

(21) Appl. No.: 13/762,253

(22) Filed: Feb. 7, 2013

(51) Int. Cl.
*E03D 11/00* (2006.01)

(52) U.S. Cl.
USPC ..... 4/254

(58) Field of Classification Search
USPC ..... 4/254
See application file for complete search history.

(56) References Cited

U.S. PATENT DOCUMENTS

| | | | | |
|---|---|---|---|---|
| 2,250,060 | A * | 7/1941 | Finlay | 4/254 |
| 2,954,566 | A * | 10/1960 | Lottenberg | 4/254 |
| 4,713,846 | A | 12/1987 | Hodroski, Jr. | |
| 4,979,240 | A | 12/1990 | Welles | |
| 5,028,024 | A * | 7/1991 | Welles | 248/163.1 |
| 5,282,279 | A | 2/1994 | Hinton et al. | |
| 5,809,583 | A | 9/1998 | Pucciani | |
| 6,293,916 | B1 | 9/2001 | Alviso | |
| 6,631,524 | B1 | 10/2003 | Dixon | |
| 7,669,934 | B1 * | 3/2010 | Cline | 297/423.45 |
| 7,814,581 | B1 | 10/2010 | Willner | |
| D629,627 | S | 12/2010 | Mylet | |
| 2009/0145340 | A1 | 6/2009 | Parvizian | |

FOREIGN PATENT DOCUMENTS

| | | |
|---|---|---|
| JP | 2005-330800 | 12/2005 |

OTHER PUBLICATIONS

Squatty Potty Review. (n.d.) White Squatty Potty. Retrieved on Oct. 19, 2012 from www.squattypottyreview.com/white-squatty-potty/.
Inventive ParentTM. (n.d.) Dr. Merry's PottyPal Step Stool & Foot Rest. Retrieved on Oct. 19, 2012 from www.inventiveparent.com/cgi-bin/shopper.cgi?preadd=action&key=BATLPPSS.

* cited by examiner

*Primary Examiner* — Huyen Le
(74) *Attorney, Agent, or Firm* — Richard C. Litman

(57) ABSTRACT

The therapeutic footrest for use while on the toilet is used to stimulate the evacuation reflex and to elevate the user in a position so he can squat while on a Western-style toilet. The footrest has two foot members for the user use to massage his feet and that the user can stand on while he is squatting over the toilet. The foot members are placed at opposing ends of two horizontal support bars. While the user is sitting on the toilet, he can move his feet back and forth over massage bumps on the foot members, while the foot members pivot on the footrest. When he is ready to squat, the foot members can be locked into place with locking clips so that the user can squat over the toilet.

20 Claims, 10 Drawing Sheets

THERAPEUTIC FOOTREST FOR USE WHILE ON A TOILET

BACKGROUND OF THE INVENTION

1. Field of the Invention

The present invention relates to footrests, and particularly to a therapeutic footrest for use while on a toilet to massage the user's feet.

2. Description of the Related Art

Humans can perform defecation in a number of defecation postures. The two most common are the squatting defecation posture and the sitting defecation posture. The squatting posture is used for squat toilets. It is also commonly used for defecation in the absence of toilets or other devices. The sitting defecation posture is used in Western toilets, and has a lean-forward posture or a 90° posture. In general, the posture chosen is largely a cultural decision.

In Western style toilets, the sitting position is primarily used. The sitting position causes the defecating human to assume a narrow anorectal angle, which some people believe is obstructive and causes difficulty in emptying the bowels. The sitting position can cause the defecating human being to repeat the Valsalva maneuver many times and with great force, which may overload the cardiovascular system and cause defecation syncope. Studies have also been performed with regard to the length of time needed to defecate using various postures. These studies have shown that the sitting defecation posture requires excessive expulsive effort compared to the squatting posture. Further, a sitting posture may increase diverticulosis of the colon. The magnitude of straining during defecation is at least three times greater than with the squatting posture.

The squatting defecation posture involves squatting by standing with knees and hips sharply bent and the buttocks suspended near the ground. Squat toilets are designed to facilitate this posture. It is more widespread in the developing world than in the Western world. In the US, the squatting position is colloquially known as the "catcher's position" or the "catcher's posture" because of its similarity to the posture that baseball players must maintain while playing the catcher position. Research has suggested that the squatting defecating posture can aid in the prevention of cancer, especially colorectal cancer.

The anorectal angle that results from squatting allows smooth bowel elimination as the colon is straightened out, whereas sitting causes it to become compressed and obstructive. The squatting defecation posture requires less expulsive effort when compared to the sitting defecation posture. Research further suggests that the squatting position may prevent the risk of defecation syncope and death due to cardiovascular complications associated with the sitting position, as squatting requires less amount of straining on part of the defecating individual. Additionally, squatting may be beneficial for patients suffering from the spastic pelvic floor syndrome, due to the increased anorectal angle enabled by the posture.

It has been proposed that the advantages of the squatting position may be obtained if the Western-style toilet is used in conjunction with a footrest. Thus, a therapeutic footrest for use while on the toilet solving the aforementioned problems is desired.

SUMMARY OF THE INVENTION

The therapeutic footrest for use while on a toilet is used to accelerate blood circulation, and as a result, to improve bowel movement by stimulating the evacuation reflex of the user, and then elevating the user in a position so he can squat, rather than sit, while on a Western-style toilet. The footrest has two foot members that the user may use to massage his feet, and then to stand on while he squats. The foot members are pivotally attached to opposing ends of two horizontal support bars. While the user is sitting on the toilet, he can move his feet back and forth over the massage bumps on the foot members, while the foot members pivot on their support. This swinging motion of the feet improves bowel movement, to thus making the user more comfortable. When he is ready to squat, the foot members can be locked into place with locking clips so that the user can squat over the toilet.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
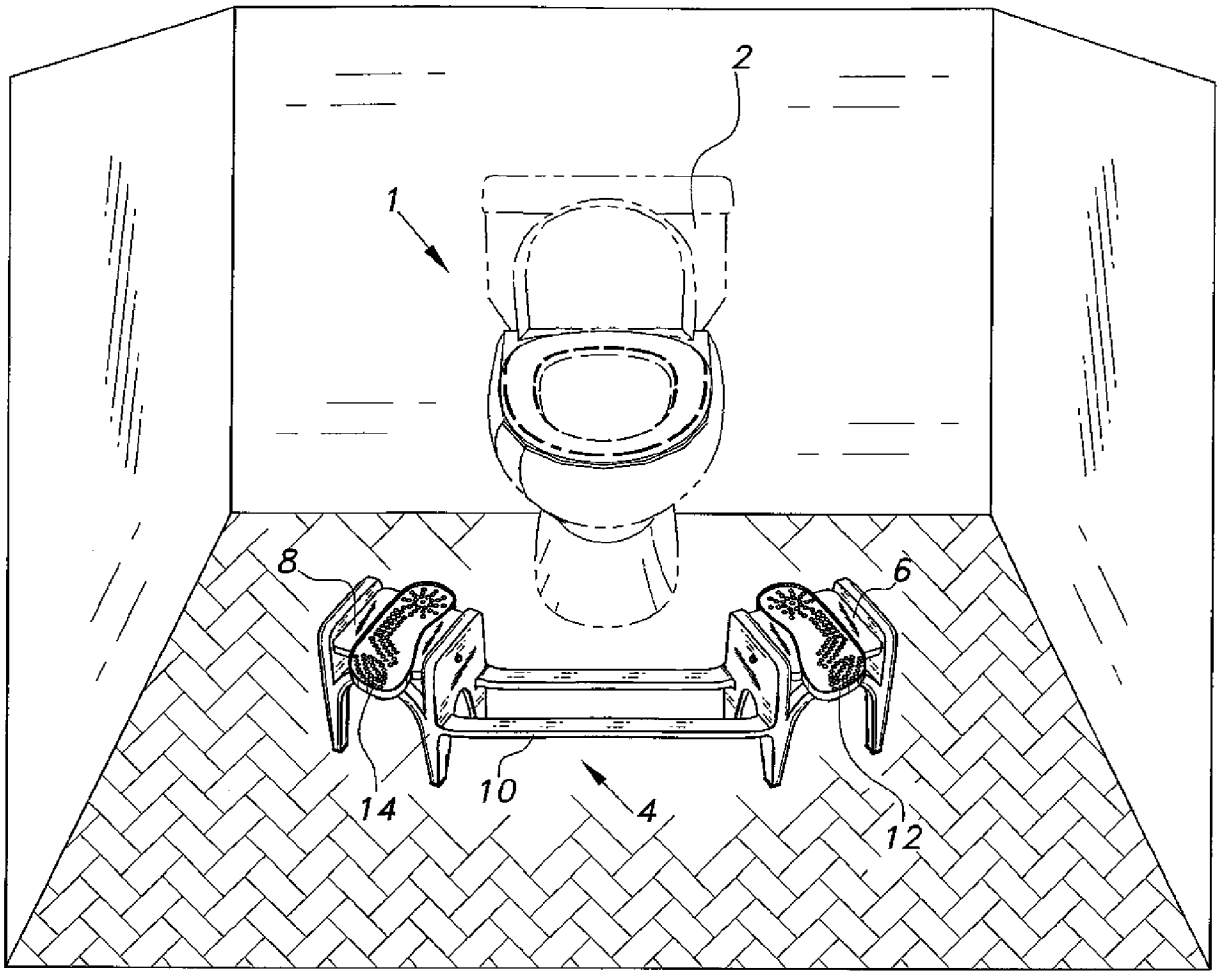
FIG. 1 is an environmental perspective view of a therapeutic footrest for use while on a toilet according to the present invention.

As diagrammatically illustrated in FIG. 1, the therapeutic footrest 4 for use while on a toilet has two foot members 12, 14 for a person who needs to go to the bathroom to use to massage his feet (and get his bowels moving), and which may also be used to stand on while he squats (to completely evacuate his bowels comfortably). The foot members 12, 14 are placed at opposing ends of two horizontal support bars 10. The support bars 10 are positioned parallel to each other with a gap in between, so that a handle is formed, such that the footrest 4 can easily be picked up by the person and moved a location that is most convenient. This makes the footrest 4 portable as well.

Figure 2:
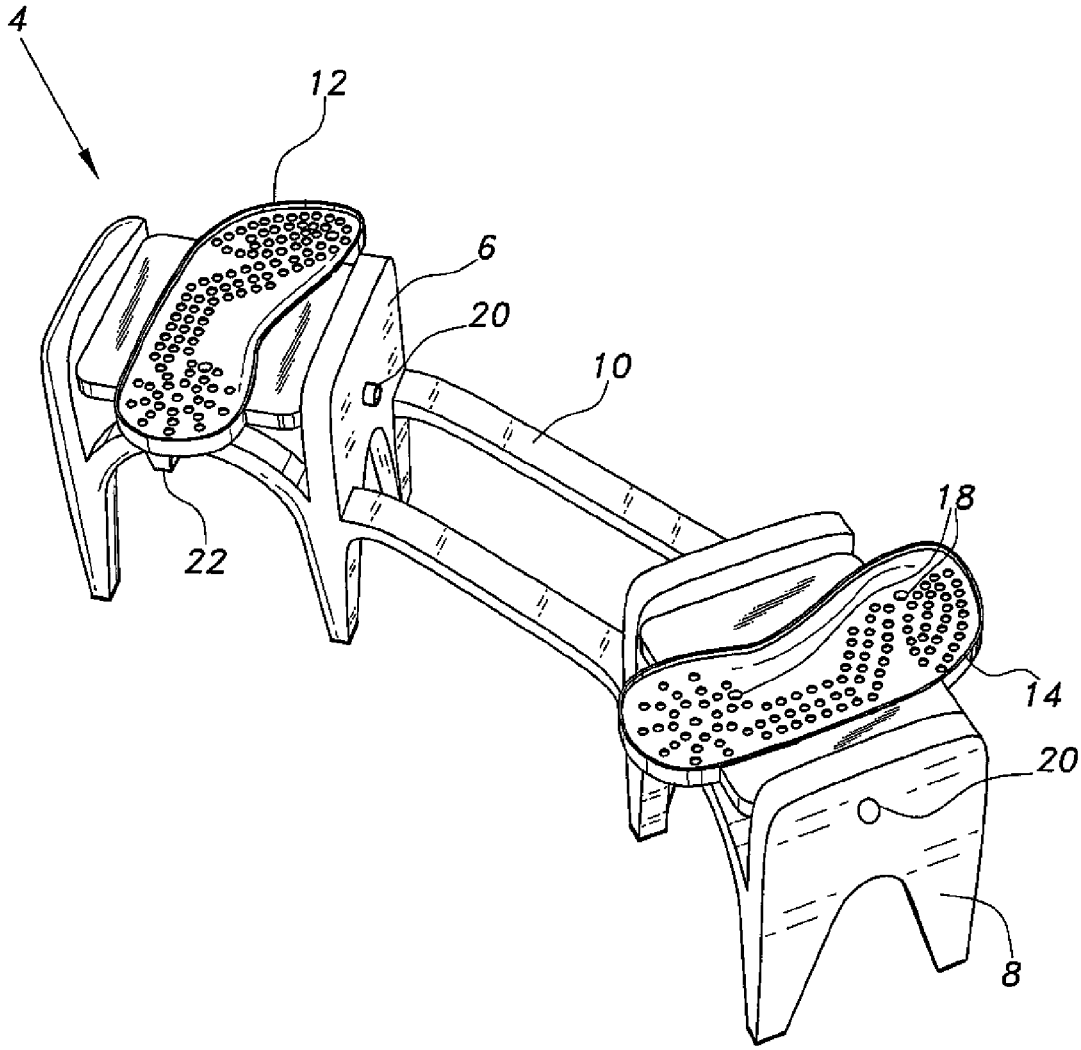
FIG. 2 is a perspective view of the therapeutic footrest of FIG. 1 as viewed from the rear and from above the footrest.

As shown in FIG. 2, the foot members 12, 14 are located on either side of the support bars 10 on support members 6, 8 so that the person can spread their feet while they are sitting on the toilet 2. In one embodiment, the foot members 12, 14 have pads that are shaped to look like a person's foot, with massage bumps on the top surface. While the person is sitting on the toilet 2, he can move his feet back and forth over the massage bumps 16 on the foot members 12, 14. Also, each of the foot members 12, 14 is mounted on a plate that has pivot pins 20 extending on opposite sides that are journaled into bores in the support members 6, 8 and serve as axles on which the foot members 12, 14 can rotate so that when the person is sitting on the toilet 2, he can move his feet back and forth over the massage bumps 16 while the foot members 12, 14 pivot on the support members 6, 8. The pivot pins may be discrete members, or may be opposite ends of an elongate rod extending through a transverse bore in the foot members 12, 14. This swinging motion of the feet improves bowel movement, thus making the person more comfortable while they are trying to defecate and empty their bowels. The evacuation reflex of the person is stimulated through this massaging motion of the feet over the massage bumps 16 by targeting the reflex zones on the bottom of the person's feet.

Figure 3A:
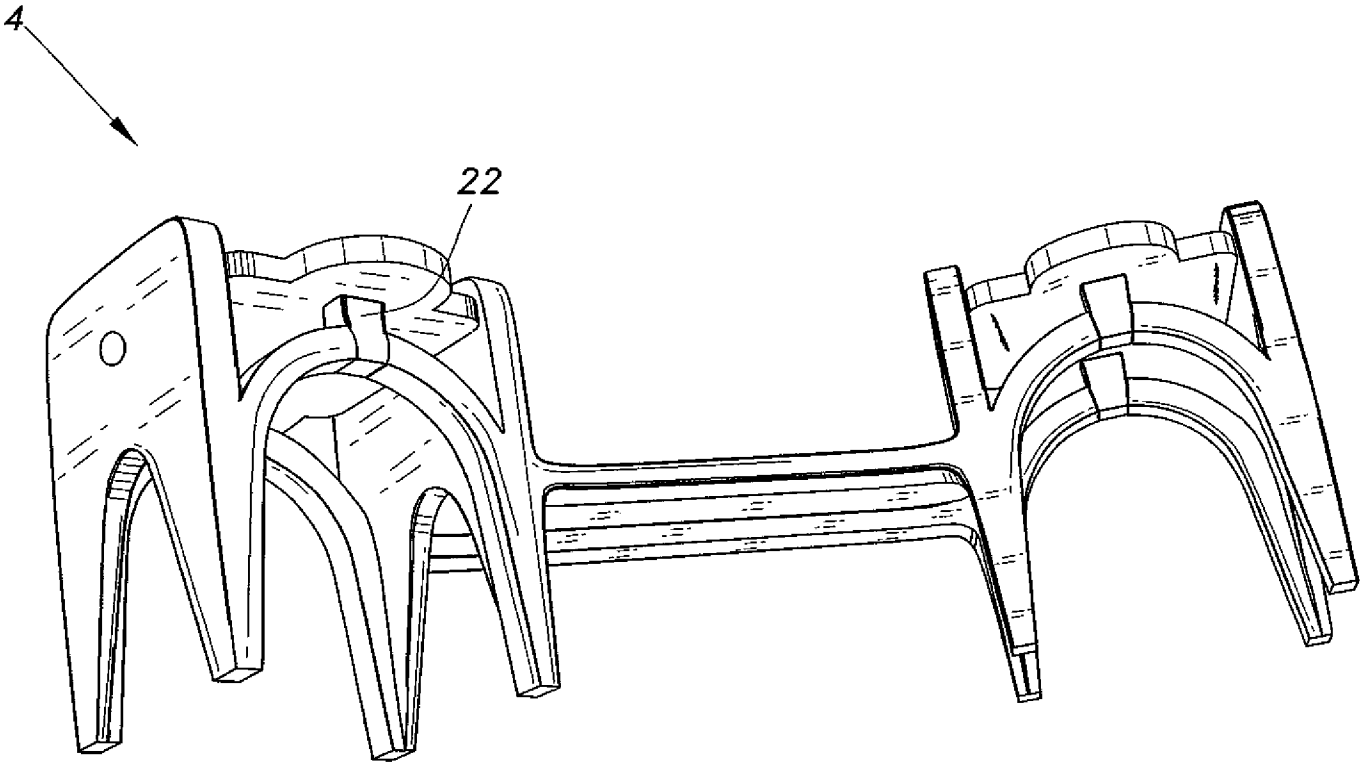
FIG. 3A is a perspective view of the therapeutic footrest of FIG. 1 as viewed from the rear and from below the footrest.
Figure 3B:
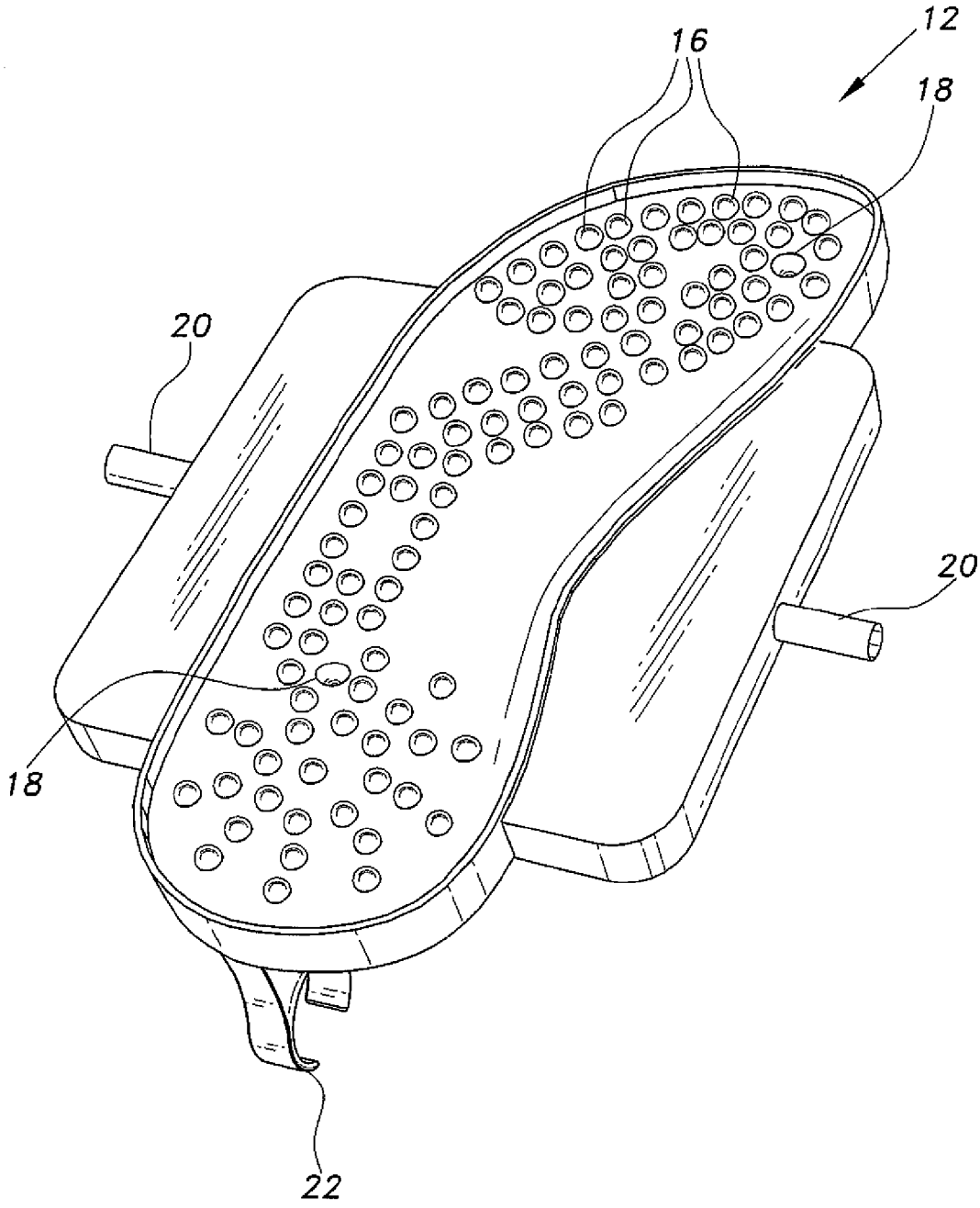
FIG. 3B is a perspective view of a foot member of the therapeutic footrest of FIG. 1, showing details thereof.
Figure 3C:
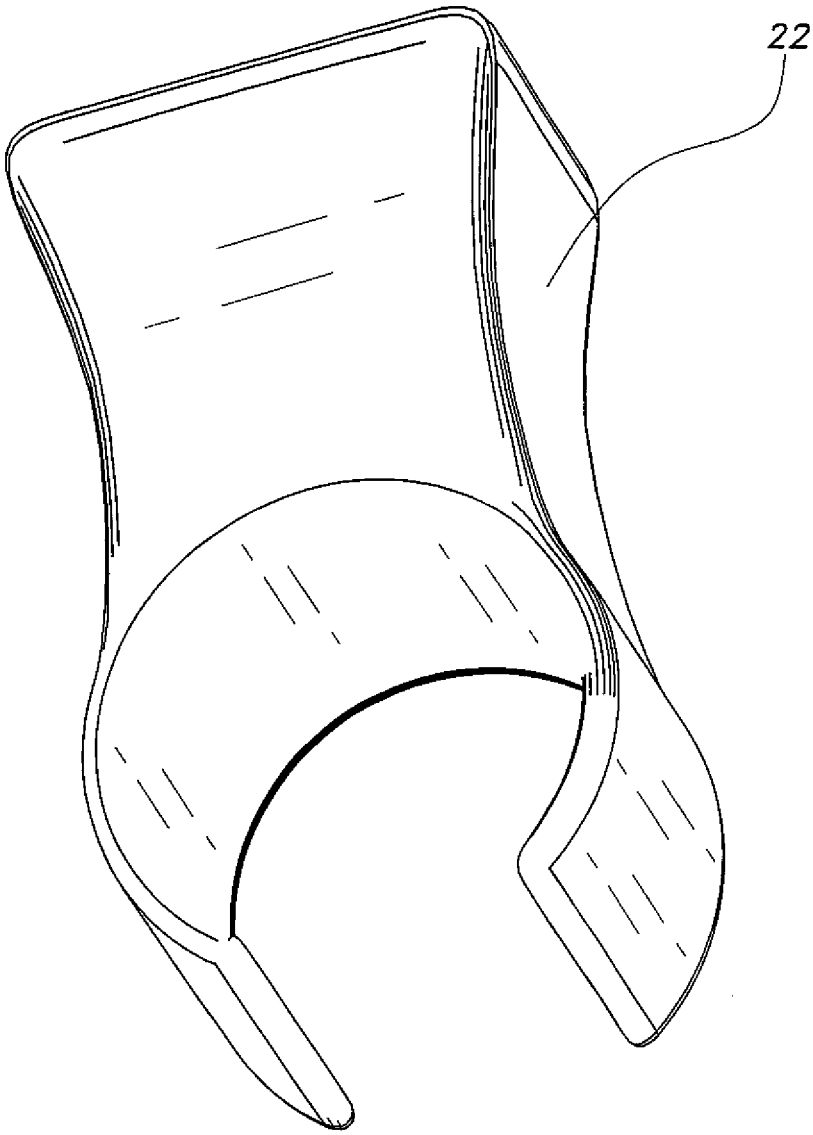
FIG. 3C is a perspective view of a locking clamp for the therapeutic footrest of FIG. 1.

When the person is ready to squat on the toilet 2, the foot members 12, 14 can be locked into place with locking clips 22 that extend downward from the plates supporting the foot members 12, 14 so that the foot members 12, 14 are no longer able to pivot, as shown in FIGS. 3A-3B. This way, the person has a stable platform to stand on. The locking clips 22 are removable and attach to the bottom of the foot members 12, 14. They clip onto the support members 6, 8 of the footrest 4, locking the foot members 12, 14 in place so they no longer move. The locking clips 22 are shaped like an hourglass, such that they can clip onto the top edges of the support members 6, 8. Each of the support members 6, 8 have opposing sidewalls that bridged by front and rear arches. The locking clips 22 releasably engage the arches. Each of the opposing sidewalls of the support members 6, 8 has an arcuate recess defined in the bottom portion, defining front and rear legs.

There are also water drainage holes 18 on the foot members 12, 14 to provide airflow through the foot members 12, 14 during the massage motion, and to drain any water that may inadvertently have come into contact with the foot members 12, 14.

Figure 4:
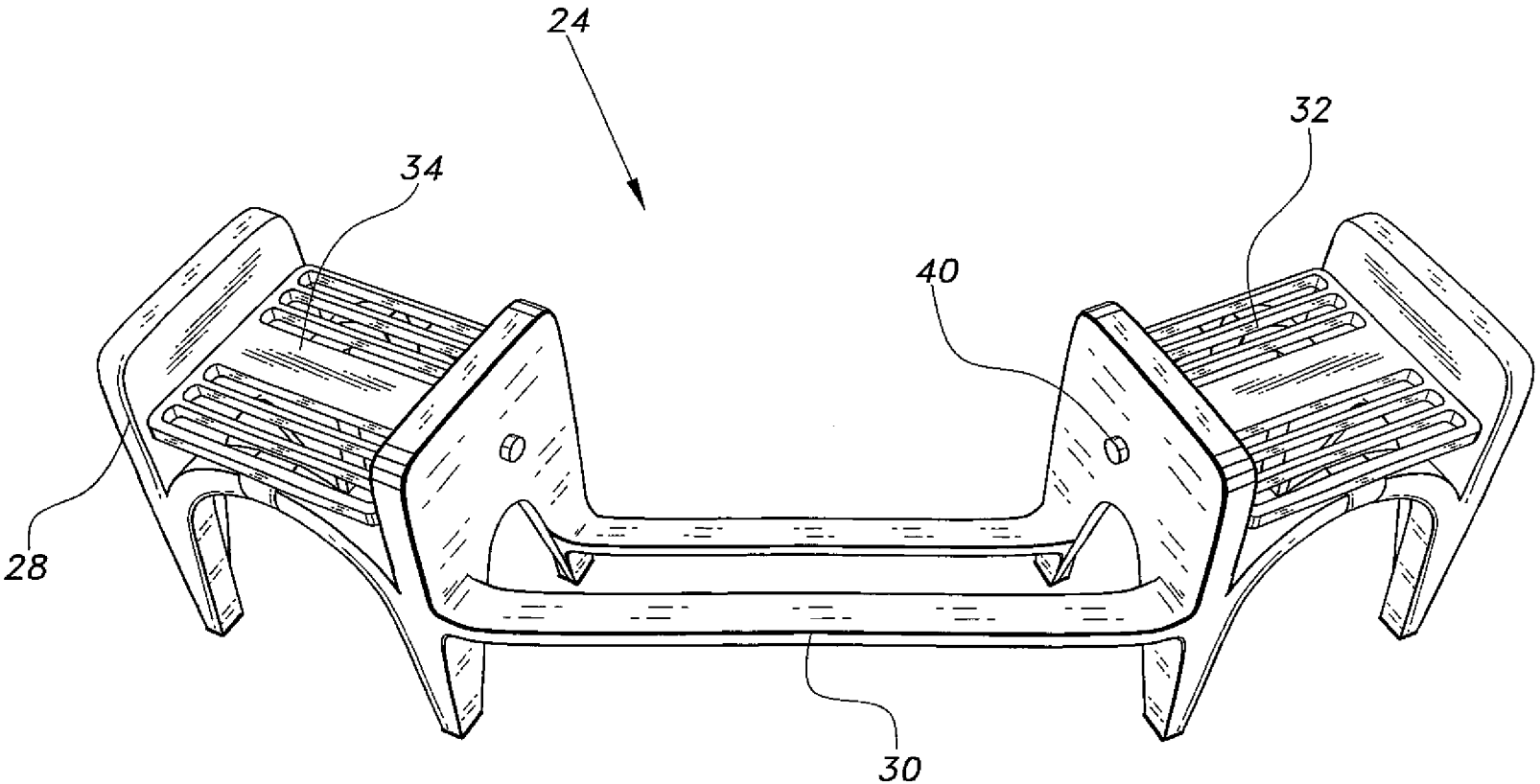
FIG. 4 is a perspective view of an alternative embodiment of a therapeutic footrest according to the present invention as viewed from the front of the footrest.
Figure 6:
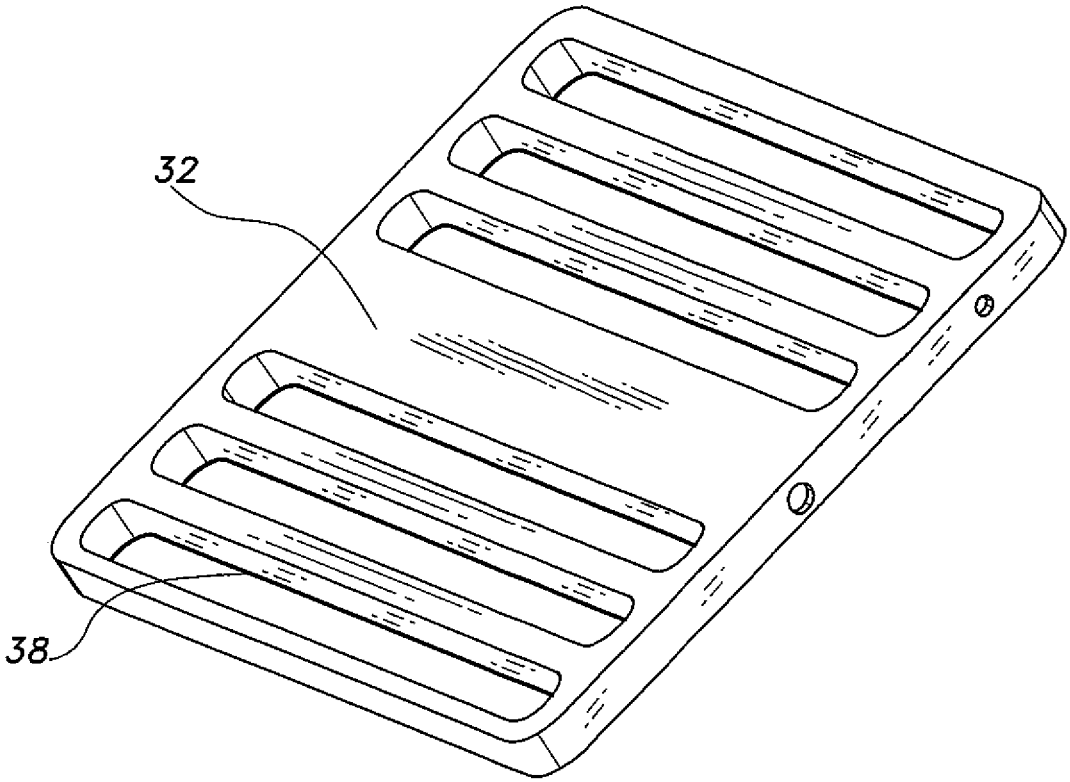
FIG. 6 is a perspective view of a foot member of the therapeutic footrest of FIG. 4.
Figure 7:
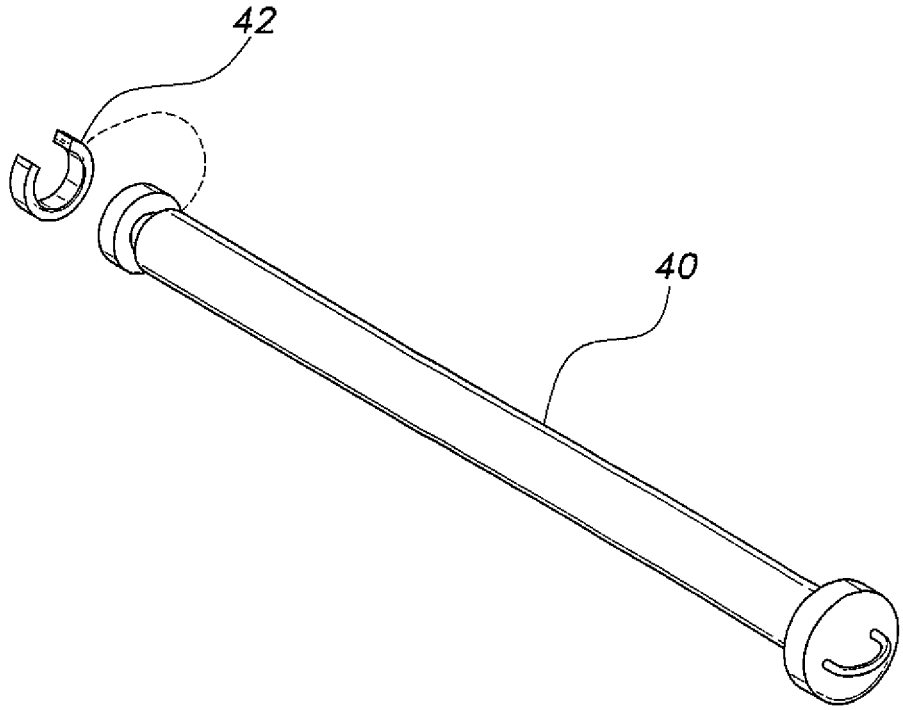
FIG. 7 is an exploded perspective view of a pivot pin and retainer clip of the therapeutic footrest of FIG. 4.

In an alternative embodiment of the footrest 24, shown in FIG. 4 and FIG. 6, support members 26, 28 have foot members 32 pivotally mounted thereon. The foot members 26, 28 are rectangular plates that have elongated, parallel oblong water drainage slots 38 defined therein (no massage bumps 16 are present in this embodiment). The edges of the slots 38 serve as the surface over which the bottom of the feet are rubbed in order to massage the reflex zones in order to encourage bowel movements while the foot members 32 pivot with the pivot pins 40 rotatably mounted in the support members 26, 28. FIG. 7 depicts a C-shaped retainer clip or snap ring 42 that locks the pivot pins 40 in place.

Figure 5:
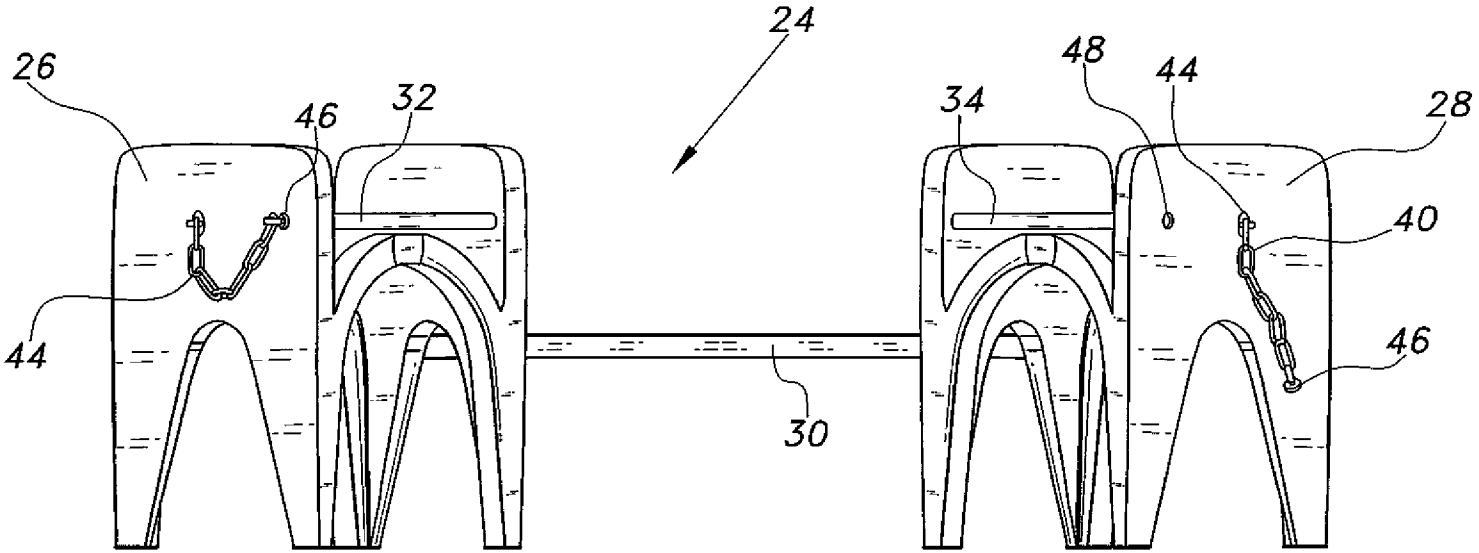
FIG. 5 is a rear view of the therapeutic footrest of FIG. 4.
Figure 8:
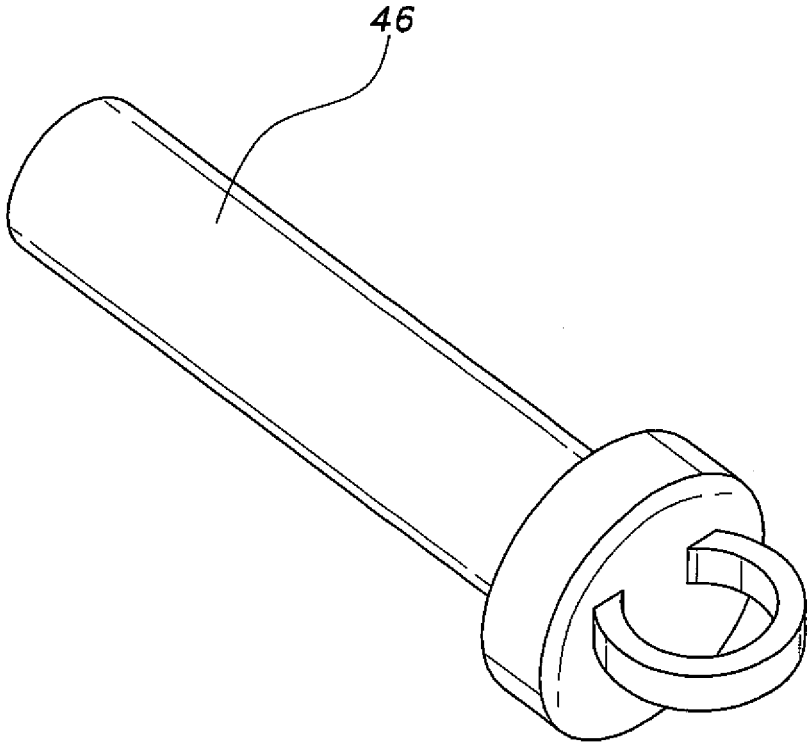
FIG. 8 is a perspective view of a lock pin of the therapeutic footrest of FIG. 4.

As shown in FIG. 5, the foot member 32 may have a lock pin 46 (shown in detail in FIG. 8) that is tethered to the outer sidewalls of the support members 26, 28 by a chain 44. The lock pin 46 may be inserted through a bore in the outer sidewall of the support member 26, 28 and into a bore in the side edge of the corresponding foot member 32, 34 in order to prevent the foot member 32, 34 from pivoting, e.g., for storage or transport.

It is to be understood that the present invention is not limited to the embodiments described above, but encompasses any and all embodiments within the scope of the following claims.

I claim:

1. A therapeutic footrest for use while on a toilet, comprising:

a pair of support members, each of the support members having a pair of opposing sidewalls, a front arch connecting the pair of sidewalls, and a rear arch connecting the pair of sidewalls;

at least one beam connecting the pair of support members; and two foot members adapted for receiving a foot of a user while seated on a toilet, each of the support members having a corresponding one of the foot members pivotally mounted thereon.

2. The therapeutic footrest according to claim 1, wherein said at least one beam comprises a pair of elongate parallel beams of different length, the support members being attached to the ends of the beams at an oblique angle.

3. The therapeutic footrest according to claim 1, wherein each said sidewall has an arcuate recess defined therein, the recess defining a front leg and a rear leg.

4. The therapeutic footrest according to claim 1, wherein each said foot member comprises a rectangular plate and a pair of pivot pins extending from opposite sides of the plate, the sidewalls of the support members having bearing holes defined therein, the pivot pins being rotatably mounted in the bearing holes in the sidewalls.

5. The therapeutic footrest according to claim 4, wherein each said foot member rectangular plate has a plurality of water drainage slots defined therein.

6. The therapeutic footrest according to claim 4, wherein each said foot member further comprises a foot-shaped pad mounted on the rectangular plate, the foot-shaped pad having a plurality of raised massage bumps attached to and protruding therefrom, so that the bottom of a foot may be moved over the massage bumps while a user is sitting on the toilet, thus allowing the evacuation reflex of a user to be stimulated by massaging reflex zones on the bottom of the foot.

7. The therapeutic footrest according to claim 6, wherein each of said foot members has a plurality of water drainage holes defined therein.

8. The therapeutic footrest according to claim 1, wherein each said foot member comprises a rectangular plate having a transverse bore defined therein and each of the sidewalls of said support members has a bearing hole defined therein, the footrest further comprising an elongate pivot pin extending through the bearing holes and the transverse bores in each said foot member, whereby each said foot member is pivotally mounted on the corresponding said foot member.

9. The therapeutic footrest according to claim 8, wherein each said pivot pin has an annular groove defined therein and further comprises a snap ring releasably engaging the groove in order to retain the pivot pin on the support member.

10. The therapeutic footrest according to claim 8, wherein each said foot member rectangular plate has a plurality of water drainage slots defined therein.

11. The therapeutic footrest according to claim 8, wherein each said foot member further comprises a foot-shaped pad mounted on the rectangular plate, the foot-shaped pad having a plurality of raised massage bumps attached to and protruding therefrom, so that the bottom of a foot may be moved over the massage bumps while a user is sitting on the toilet, thus allowing the evacuation reflex of a user to be stimulated by massaging reflex zones on the bottom of the foot.

12. The therapeutic footrest according to claim 11, wherein each of said foot members has a plurality of water drainage holes defined therein.

13. The therapeutic footrest according to claim 8, wherein each said rectangular plate has a stop hole defined therein and each said support member has an outer wall having an aperture defined therein, the footrest further comprising a lock pin tethered to each of the outer walls, the lock pin being removably insertable through the aperture in the outer wall and into the stop hole in order to selectively prevent said foot members from pivoting.

14. The therapeutic footrest according to claim 1, wherein each said foot member further comprises at least one locking clip extending downward therefrom, the at least one locking clip selectively engaging one of the arches in order to selectively prevent said foot members from pivoting.

15. A therapeutic system, comprising:

a western-style toilet; and a footrest having:

a pair of support members, each of the support members having a pair of opposing sidewalls, a front arch connecting the pair of sidewalls, and a rear arch connecting the pair of sidewalls;

a pair of elongate parallel beams of different length, the support members being attached to the ends of the beams at an oblique angle; and two foot members adapted for receiving a foot of a user while seated on the toilet, each of the support members having a corresponding one of the foot members pivotally mounted thereon.

16. The therapeutic system according to claim 15, wherein each said foot member rectangular plate has a plurality of water drainage slots defined therein.

17. The therapeutic footrest according to claim 15, wherein each said foot member further comprises a foot-shaped pad mounted on the rectangular plate, the foot-shaped pad having a plurality of raised massage bumps attached to and protruding therefrom, so that the bottom of a foot may be moved over the massage bumps while a user is sitting on the toilet, thus allowing the evacuation reflex of a user to be stimulated by massaging reflex zones on the bottom of the foot.

18. The therapeutic footrest according to claim 17, wherein each of said foot members has a plurality of water drainage holes defined therein.

19. The therapeutic system according to claim 15, wherein each said foot member further comprises at least one locking clip extending downward therefrom, the at least one locking clip selectively engaging one of the arches in order to selectively prevent said foot members from pivoting.

20. A therapeutic method of stimulating evacuation reflexes while on a toilet, comprising the steps of:

sitting on a western-style toilet;

placing a footrest in front of the toilet, the footrest comprising: a pair of support members, each of the support members having a pair of opposing sidewalls, a front arch connecting the pair of sidewalls, and a rear arch connecting the pair of sidewalls;

at least one beam connecting the pair of support members; and two foot members adapted for receiving a foot of a user while seated on a toilet, each of the support members having a corresponding one of the foot members pivotally mounted thereon;

placing the feet of the user on the footrest;

moving the feet of the user over massage bumps on foot members of the footrest while pivoting the foot members, thus stimulating evacuation reflexes of a user by massaging reflex zones on the bottom of the foot;

locking the foot members to prevent pivoting; and squatting over the toilet while standing on the footrest to completely evacuate the bowels of the user into the toilet.

* * * * *